US007413836B2

(12) United States Patent
Kim et al.

(10) Patent No.: US 7,413,836 B2
(45) **Date of Patent: *Aug. 19, 2008**

(54) ELECTROPHOTOGRAPHIC PHOTORECEPTOR CONTAINING ASYMMETRICAL NAPHTHALENETETRACARBOXYLIC ACID DIIMIDE DERIVATIVE AS ELECTRON TRANSPORTING MATERIAL IN A CHARGE GENERATING LAYER AND ELECTROPHOTOGRAPHIC IMAGE FORMING APPARATUS EMPLOYING THE PHOTORECEPTOR

(75) Inventors: Seung-ju Kim, Suwon-si (KR); Beom-jun Kim, Yongin-si (KR); Saburo Yokota, Suwon-si (KR); Kyung-yol Yon, Seongnam-si (KR); Moto Makino, Suwon-si (KR); Hwan-koo Lee, Suwon-si (KR); Ji-young Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 68 days.

This patent is subject to a terminal disclaimer.

(21) Appl. No.: 11/516,595

(22) Filed: Sep. 7, 2006

(65) Prior Publication Data

US 2007/0065740 A1 Mar. 22, 2007

(30) Foreign Application Priority Data

Sep. 16, 2005 (KR) ..... 10-2005-0086998

(51) Int. Cl.
*G03G 5/047* (2006.01)

(52) U.S. Cl. ..... 430/59.4; 430/59.1; 399/159

(58) Field of Classification Search ..... 430/59.1, 430/59.4; 399/159

See application file for complete search history.

(56) References Cited

U.S. PATENT DOCUMENTS

| | | | |
|---|---|---|---|
| 5,055,367 | A | 10/1991 | Law |
| 6,127,076 | A | 10/2000 | Ishigami et al. |
| 2002/0141032 | A1 | 10/2002 | Guarr et al. |

FOREIGN PATENT DOCUMENTS

| | | |
|---|---|---|
| EP | 1 445 115 | 8/2004 |

OTHER PUBLICATIONS

Sule Erten, Yevgen Posokhov, Serap Alp and Siddik Icli, "The study of the solubility of naphthalene diimides with various bulky flanking substituents in different solvents by UV-vis spectroscopy", Dyes and Pigments, vol. 64, Issue 2, Feb. 2005, pp. 171-178.*

Diamond, Arthur S & David Weiss (eds.) Handbook of Imaging Materials, 2nd ed.. New York: Marcel-Dekker, Inc. (Nov. 2001) pp. 369-379. 388-395.*

* cited by examiner

*Primary Examiner*—Christopher RoDee
(74) *Attorney, Agent, or Firm*—Roylance, Abrams, Berdo & Goodman, L.L.P.

(57) ABSTRACT

An electrophotographic photoreceptor including: an electrically conductive substrate; a charge generating layer disposed on the electrically conductive substrate and includes a charge generating material dispersed or dissolved in a binder resin and an asymmetric naphthalenetetracarboxylic acid diimide derivative having a nitro group dispersed or dissolved in the binder resin. The photoreceptor also has a charge transporting layer that is disposed on the charge generating layer and includes a charge transporting material that is dispersed or dissolved in the binder resin. An electrophotographic image forming apparatus including the electrophotographic photoreceptor. The two-layered type electrophotographic photoreceptor has good interlayer adhesive force and good electrical properties such as good photosensitivity and low residual potential after exposure.

16 Claims, 3 Drawing Sheets

ELECTROPHOTOGRAPHIC PHOTORECEPTOR CONTAINING ASYMMETRICAL NAPHTHALENETETRACARBOXYLIC ACID DIIMIDE DERIVATIVE AS ELECTRON TRANSPORTING MATERIAL IN A CHARGE GENERATING LAYER AND ELECTROPHOTOGRAPHIC IMAGE FORMING APPARATUS EMPLOYING THE PHOTORECEPTOR

CROSS-REFERENCE TO RELATED PATENT APPLICATION

This application claims the benefit of Korean Patent Application No. 10-2005-0086998, filed on 16 Sep., 2005, in the Korean Intellectual Property Office, the disclosure of which is hereby incorporated by reference in its entirety.

BACKGROUND OF THE INVENTION

1. Field of the Invention

The present invention relates to an electrophotographic photoreceptor and an electrophotographic image forming apparatus. More particularly, the invention relates to a two-layered type electrophotographic photoreceptor including a naphthalenetetracarboxylic acid diimide derivative having a nitro group as an electron transporting material in a charge generating layer including a charge generating material. The photoreceptor has improved electrostatic properties such as photosensitivity and residual potential. The present invention also relates to an electrophotographic image forming apparatus including the electrophotographic photoreceptor.

2. Description of the Related Art

Electrophotography is widely used in laser printers, photocopiers, facsimile machines, LED printers, CRT printers, and laser electrophotographs, and the like. An electrophotographic photoreceptor includes a photosensitive layer formed on an electrically conductive substrate and can be in the form of a plate, a disk, a sheet, a belt, or a drum, etc. In an electrophotographic photoreceptor, a surface of the photosensitive layer is uniformly and electrostatically charged, and then the charged surface is exposed to a pattern of light, thus forming an image. The light exposure selectively dissipates the charge in the exposed regions where the light strikes the surface, thereby forming a pattern of charged and uncharged regions. This pattern is referred to as a latent image. Then a wet or dry toner is supplied in the vicinity of the latent image, and toner droplets or particles are deposited in either the charged or uncharged region to form a toner image on the surface of the photosensitive layer. The resulting toner image can be transferred and fixed to a suitable final or intermediate receiving surface, such as paper, or the photosensitive layer can function as the final receptor for receiving the image.

Electrophotographic photoreceptors can be classified into two types. The first is a type having a structure including a charge generating layer (CGL) comprising a charge generating material (CGM), a binder resin, and a charge transporting layer (CTL) comprising a binder resin and a charge transporting material (primarily, a hole transporting material (HTM)). In general, the two-layered type electrophotographic photoreceptors are used in the fabrication of negative (−) type electrophotographic photoreceptors. The other type is a single-layered type photoreceptor in which a binder resin, a charge generating material, a hole transporting material (HTM), and an electron transporting material (ETM) are contained in a single layer. In general, the single-layered type photoreceptors are used in the fabrication of positive (+) type electrophotographic photoreceptors.

The charge generating material is provided for the purpose of generating charge carriers (that is, holes and/or electrons) upon exposure. The purpose of the charge transporting material is to receive at least one type of the charge carriers and transport them through the charge transporting layer in order to facilitate the discharge of the surface charges on the photoreceptor.

The amount of the charge generating material in the charge generating layer of the two-layered type electrophotographic photoreceptor needs to be large in order to obtain an electrophotographic photoreceptor with high photosensitivity. However, if the amount of the charge generating material is too large, the stability of the coating slurry for forming the charge generating layer may be degraded, thus degrading the coating quality of the charge generating layer. Also, the adhesive force of the charge generating layer and the charge generating layer and an electrically conductive substrate and the adhesive force of the charge transporting layer may be degraded. On the contrary, if the amount of the charge generating material is low, the stability of the coating slurry for forming the charge generating layer, the coating quality of the charge generating layer, the adhesive force of the charge generating layer and the electrically conductive substrate and the adhesive force of the charge generating layer and the charge transporting layer may be improved, but the electrostatic properties may be radically degraded such that the photosensitivity of the electrophotographic photoreceptor may decrease and the residual potential may increase.

Also, regardless of the amount of the charge generating material in the charge generating layer, electron transportation in the charge generating layer is not good, thereby adversely affecting the electrostatic properties of the electrophotographic photoreceptor such that the photosensitivity of the electrophotographic photoreceptor tends to be low and the residual potential thereof tends to be high. In particular, since the charges are mainly generated in the upper portion of the charge generating layer, degradation of the electrostatic properties due to poor electron transportation occurs more significantly when the thickness of the charge generating layer is increased for high photosensitivity.

U.S. Pat. Nos. 5,547,790, 5,571,648, and 5,677,094 respectively disclose an electrophotographic photoreceptor, for solving the above described problems, U.S. Pat. No. 5,547,790 discloses an electrophotographic photoreceptor including at least a charge generating layer and a charge transporting layer that are sequentially stacked on an electrically conductive substrate. The charge generating layer includes a charge generating material selected from the group consisting of azo pigments, perynone pigments, and squaraines and a polymeric charge transporting material. The charge transporting layer includes a polymeric charge transporting material. The polymer charge transporting material in the charge generating layer is selected from a polysirylene, a polymer having a hydrazone structure on the main bone and/or side chain thereof, and a polymer having a tertiary amine structure on the main bone and/or side chain thereof. The polymer charge transporting material in the charge transporting layer is a polymer having a polysirylene, a polymer having a hydrazone on the main bone and/or side bone thereof, and a polymer having a tertiary amine structure on the main bone and/or side chain thereof.

U.S. Pat. No. 5,571,648 discloses an electrophotographic imaging member comprising a support substrate having a two electrically conductive ground plane layer comprising a layer comprising zirconium over a layer comprising titanium, a hole blocking layer, an adhesive layer comprising a copolyester film forming resin, an intermediate layer in contact with the adhesive layer, where the intermediate layer comprises a film forming carbazole polymer, a charge generating layer comprising perylene or phthalocyanine particles dispersed in a film forming a polymer binder blend of polycarbonate and carbazole polymer, and a hole transporting layer, wherein the hole transporting layer is substantially non-absorbing in the spectral region at which the charge generating layer generates and injects photogenerated holes but is capable of supporting the injection of photogenerated holes from the charge generating layer and transporting the holes through the charge transporting layer.

U.S. Pat. No. 5,677,094 discloses an electrophotographic photoconductor comprising an electroconductive support and a photoconductive layer formed on the electroconductive support and including a charge generating layer and a charge transporting layer, wherein the charge generating layer comprises a first polymeric charge transporting material having an ionization potential of 6.0 eV or less, and the charge transporting layer comprises a charge transporting small molecule and a binder.

The electrophotographic photoreceptors disclosed in the above U.S. Patents tried to improve electrostatic properties by further incorporating hole transporting material besides the charge generating material to the charge generating layer. However, an electrophotographic photoreceptor with improved electrostatic properties is still required.

SUMMARY OF THE INVENTION

The present invention provides an electrophotographic photoreceptor with excellent electrical properties such as high photosensitivity and low residual potential after exposure.

The present invention also provides an electrophotographic image forming apparatus including the electrophotographic photoreceptor.

According to an aspect of the present invention, an electrophotographic photoreceptor is provided comprising: an electrically conductive substrate; a charge generating layer that is disposed on the electrically conductive substrate and comprises a charge generating material dispersed or dissolved in a binder resin and a naphthalenetetracarboxylic acid diimide derivative represented by Formula 1 and dispersed or dissolved in the binder resin; and a charge transporting layer that is disposed on the charge generating layer and comprises a charge transporting material that is dispersed or dissolved in a binder resin,

[Formula 1]

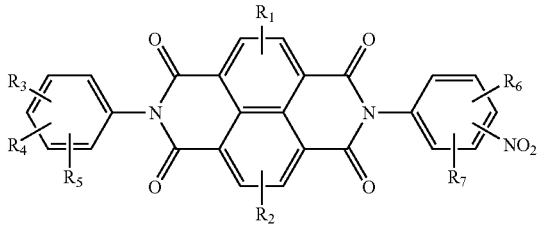

wherein $R_1$, $R_2$, $R_3$, $R_4$, $R_5$, $R_6$, and $R_7$ are each independently one selected from the group consisting of a hydrogen atom, a halogen atom, a substituted or unsubstituted $C_1$-$C_{20}$ alkyl group, a substituted or unsubstituted $C_1$-$C_{20}$ alkoxy group, a substituted or unsubstituted $C_6$-$C_{30}$ aryl group, and a substituted or unsubstituted $C_7$-$C_{30}$ aralkyl group.

According to another aspect of the present invention, an electrophotographic image forming apparatus is provided comprising an electrophotographic photoreceptor, wherein the electrophotographic photoreceptor comprises: an electrically conductive substrate; a charge generating layer that is disposed on the electrically conductive substrate and comprises a charge generating material that is dispersed or dissolved in a binder resin and a naphthalenetetracarboxylic acid diimide derivative that is represented by Formula 1 and dispersed or dissolved in the binder resin; and a charge transporting layer that is disposed on the charge generating layer and comprises a charge transporting material that is dispersed or dissolved in a binder resin,

[Formula 1]

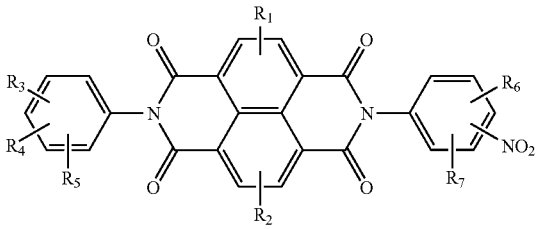

wherein $R_1$, $R_2$, $R_3$, $R_4$, $R_5$, $R_6$, and $R_7$ are each independently one selected from the group consisting of a hydrogen atom, a halogen atom, a substituted or unsubstituted $C_1$-$C_{20}$ alkyl group, a substituted or unsubstituted $C_1$-$C_{20}$ alkoxy group, a substituted or unsubstituted $C_6$-$C_{30}$ aryl group, and a substituted or unsubstituted $C_7$-$C_{30}$ aralkyl group.

The electrophotographic photoreceptor is a two-layered type electrophotographic photoreceptor and further includes an asymmetric naphthalenetetracarboxylic acid diimide compound having a nitro group of Formula 1 in the conventional charge generating layer comprising a charge generating material and a binder resin. Thus, the photoreceptor has good interlayer adhesion and good electrical properties such as high photosensitivity and low residual potential. It is assumed that the amount of the charge generating material is reduced to improve the stability of the coating slurry for the charge generating layer, thereby improving the coating quality of the charge generating layer and the interlayer adhesion, and the electron transporting material is further added to the charge generating layer in addition to the charge generating layer so that electrons generated from the charge generating material can be transported to the electrically conductive substrate fast and easily and can be easily injected to the electrically conductive substrate from the charge generating layer. Accordingly, high quality image can be obtained using the electrophotographic photoreceptor.

These and other aspects of the invention will become apparent from the following detailed description of the invention which disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
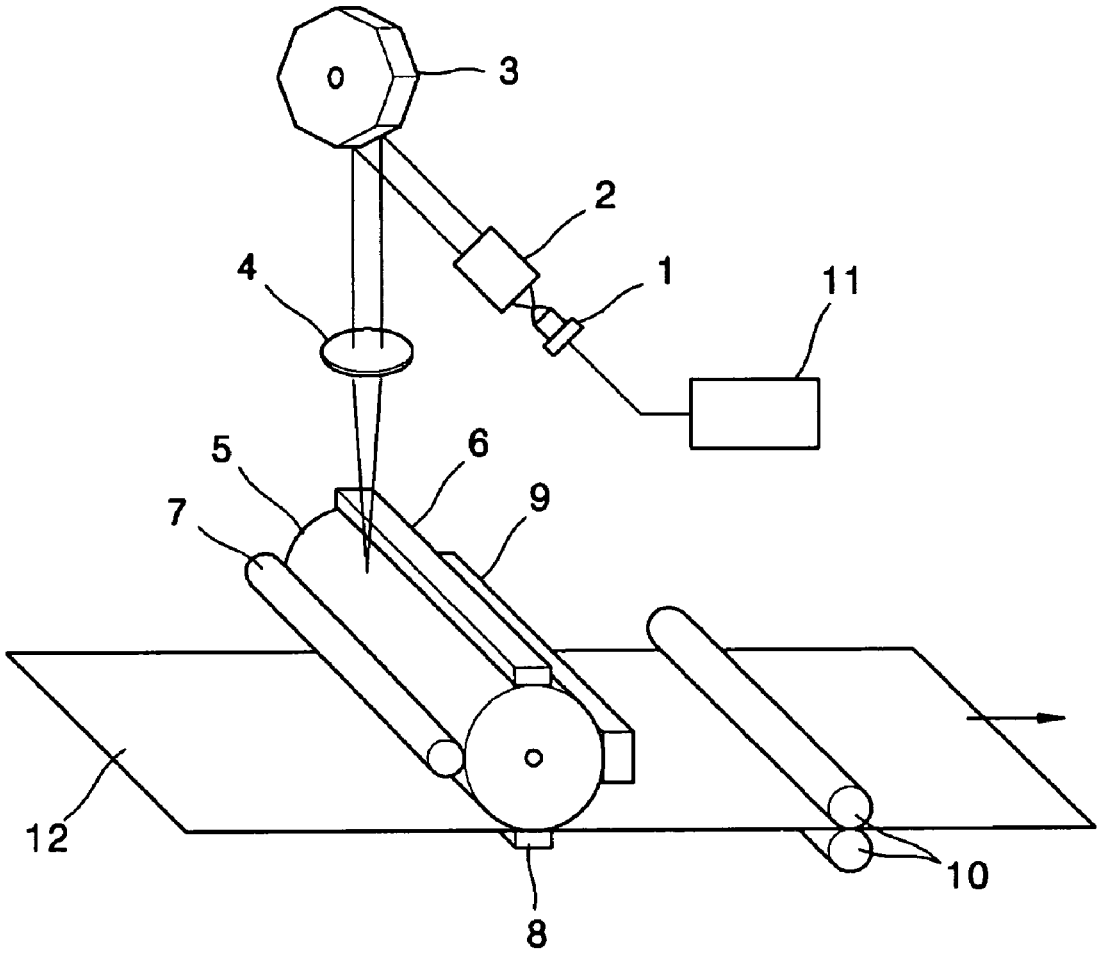
FIG. 1 schematically illustrates an image forming apparatus according to an embodiment of the present invention.

The present invention will now be described more fully with reference to the accompanying drawings, in which exemplary embodiments of the invention are shown.

An electrophotographic photoreceptor according to an embodiment of the present invention has a two-layered type structure in which a charge generating layer and a charge transporting layer are sequentially formed on an electrically conductive substrate as a photosensitive layer.

The electrically conductive substrate may be composed of an electrically conductive material, for example, metal and an electrically conductive polymer, etc. and is in the form of a plate, a disk, a sheet, a belt, or a drum, etc. Examples of the metal include aluminum, vanadium, nickel, copper, zinc, palladium, indium, tin, platinum, stainless steel, and chromium, etc. Examples of the electrically conductive polymer include polyester resin, polycarbonate resin, polyamide resin, polyimide resin, mixtures thereof and copolymers thereof, in which an electrically conductive material is dispersed, such as electrically conductive carbon, tin oxide, indium oxide. Also, the electrically conductive substrate may be a metal sheet or an organic polymer sheet on which metal is deposited or laminated.

An intermediate layer may be formed between the electrically conductive substrate and the charge generating layer which will be described hereinafter. The intermediate layer improves image characteristics by suppressing hole injection from the electrically conductive substrate to the photosensitive layer, improves interlayer adhesion of the electrically conductive substrate and the photosensitive layer, and prevents the dielectric breakdown of the photosensitive layer. Examples of the intermediate layer include an anodic aluminum oxide layer; a resin dispersion layer of metal oxide powder such as titanium oxide, tin oxide, indium oxide, etc.; and a resin layer formed of polyvinyl alcohol, casein, ethyl cellulose, gelatin, phenolic resin, or polyamide, etc. The thickness of the intermediate layer may be in the range of 0.05-5 μm, but is not limited thereto.

A charge generating layer and a charge transporting layer are formed as a photosensitive layer on the electrically conductive substrate or the intermediate layer of the two-layered type electrophotographic photoreceptor according to the present embodiment.

The charge generating layer includes a binder resin in which the charge generating material and the naphthalenetetracarboxylic acid diimide derivative of Formula 1 above are dispersed and/or dissolved.

Examples of the charge generating material include: organic materials such as phthalocyanine-based compounds, azo-based compounds, bisazo-based compounds, triazo-based compounds, quinone-based pigments, perylene-based compounds, indigo-based compounds, bisbenzoimidazole-based pigments, anthraquinone-based compounds, quinacridone-based compounds, azulenium-based compounds, squarylium-based compound, pyrylium-based compound, triarylmethane-based compounds, cyanine-based compounds, perinone-based compound, polycycloquinone compound, pyrrolopyrrol compound, and naphthalocyanine compound; and inorganic materials such as amorphous silicon, amorphous selenium, tetragonal selenium, tellurium, selenium-tellurium alloy, cadmium sulfide, antimony sulfide, zinc sulfide, etc. Examples of the charge generating material of the photosensitive layer are not limited to these, and the materials can be used alone or in combination of two or more.

The charge generating material may be phthalocyanine-based pigments. The phthalocyanine-based pigments may be a metal-free phthalocyanine-based compound represented by Formula 2 below, a metal phthalocyanine-based compound represented by Formula 3, or a mixture of these,

[Formula 2]

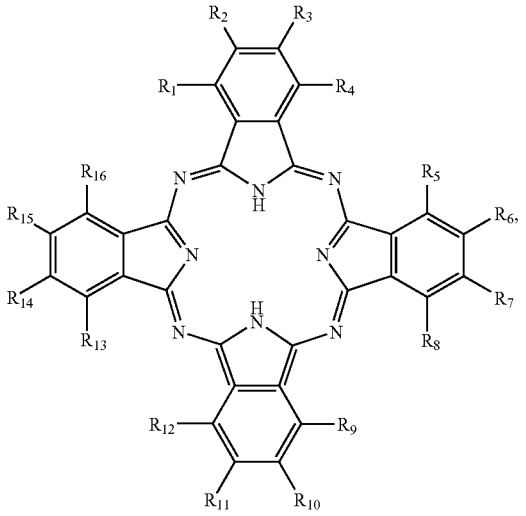

[Formula 3]

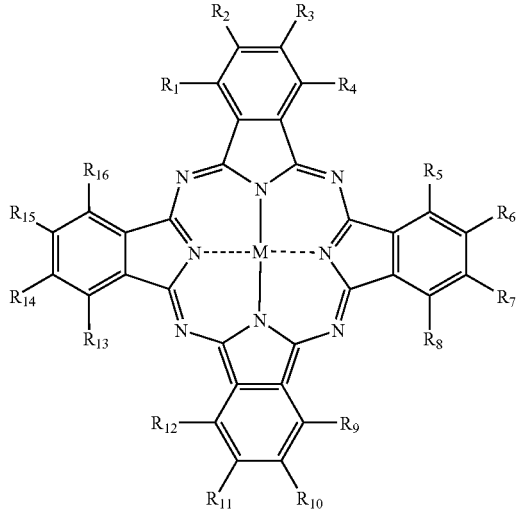

where $R_1$-$R_{16}$ are each independently a hydrogen atom, a halogen atom, a nitro group, a substituted or unsubstituted $C_1$-$C_{20}$ alkyl group, or a substituted or unsubstituted $C_1$-$C_{20}$ alkoxy group, and M is copper, chloroaluminium, chloroindium, chlorogallium, chlorogermanium, oxyvanadyl, oxytitanyl, hydroxygermanium, or hydroxygallium.

Examples of the phthalocyanine pigments are oxytitanyl phthalocyanine pigments such as d type or y type oxytitanyl phthalocyanine having the strongest diffraction peak at a Bragg angle (2θ±0.2°) of 27.1° in a powder X-ray diffraction diagram, β type oxytitanyl phthalocianine having the strongest diffraction peak at a Bragg angle (2θ±0.2°) of 26.1°, or α type oxytitanyl phthalocyanine having Bragg angle (2θ±0.2°) of 7.5°; or metal-free phthalocyanine pigments such as X type metal-free phthalocyanine or T(tau) type metal-free phthalocyanine having the strongest diffraction peak at a Bragg angle (2θ±0.2°) of 7.5° and 9.2° in a powder X-ray diffraction diagram. The phthalocyanine pigments are efficient in the present invention as they show the highest photosensitivity in the wavelength range of 780 nm to 800 nm and the photosensitivity can be selected according to the crystal structures thereof.

The charge generating layer of the two-layered type electrophotographic photoreceptor further includes a naphthalenetetracarboxylic acid diimide derivative represented by Formula 1 below as a charge transporting material in addition to a charge generating material.

The naphthalenetetracarboxylic acid diimide derivative of Formula 1 below has an asymmetric structure and thus has good solubility in an organic solvent and high compatibility with a polymeric binder resin. Also, electron transporting ability is improved by introducing a nitro group having a high electron affinity. Accordingly, when the naphthalenetetracarboxylic acid diimide derivative is added as an ETM to the charge generating layer, a two-layered type electrophotographic photoreceptor with good interlayer adhesion and good electrical characteristics can be obtained.

[Formula 1]

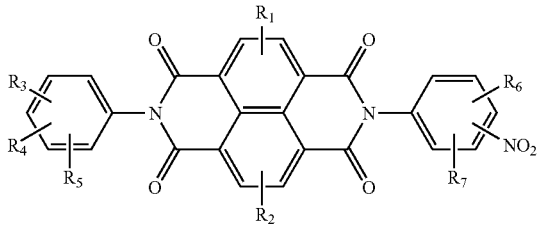

wherein $R_1$, $R_2$, $R_3$, $R_4$, $R_5$, $R_6$, and $R_7$ are each independently one selected from the group consisting of a hydrogen atom, a halogen atom, a substituted or unsubstituted $C_1$-$C_{20}$ alkyl group, a substituted or unsubstituted $C_1$-$C_{20}$ alkoxy group, a substituted or unsubstituted $C_6$-$C_{30}$ aryl group, and a substituted or unsubstituted $C_7$-$C_{30}$ aralkyl group.

The halogen atom represents fluorine, chlorine, bromine, or iodine.

The alkyl group is a $C_1$-$C_{20}$ linear or branched alkyl group, preferably, a $C_1$-$C_{12}$ linear or branched alkyl group. Examples of the alkyl group include, methyl, ethyl, n-propyl, isopropyl, n-butyl, isobutyl, sec-butyl, tert-butyl, pentyl, hexyl, 1,2-dimethyl-propyl, and 2-ethyl hexyl. The alkyl group may be substituted with a halogen atom such as fluorine, chlorine, bromine, or iodine.

The alkoxy group is a $C_1$-$C_{20}$ linear or branched alkoxy group, preferably a $C_1$-$C_{12}$ linear or branched alkoxy group. Examples of the alkoxy group include methoxy, ethoxy group, and propoxy group. The alkoxy group may be substituted with a halogen atom such as fluorine, chlorine, bromine, or iodine.

The aralkyl group is a $C_7$-$C_{30}$ linear or branched aralkyl group, preferably a $C_7$-$C_{15}$ linear or branched aralkyl group. Examples of the aralkyl group include benzyl group, methylbenzyl group, phenylethyl group, naphthylmethyl group, and naphthylethyl group. The aralkyl group may be substituted with a halogen atom such as fluorine, chlorine, bromine, or iodine, or may be substituted with an alkyl group, alkoxy group, nitro group, hydroxyl group, or sulfonic acid group.

The aryl group is a $C_6$-$C_{30}$ aromatic ring. Examples of the aryl group include phenyl, tolyl, xylyl, biphenyl, o-terphenyl, naphtyl, anthracenyl, phenanthrenyl, and the like. The aryl group may be substituted with an alkyl group, alkoxy group, nitro group, hydroxy group, sulfonic acid group, or a halogen atom.

Specific examples of the asymmetric naphthalenetetracarboxylic acid diimide derivative having a nitro group according to Formula 1 include the following compounds:

(1)

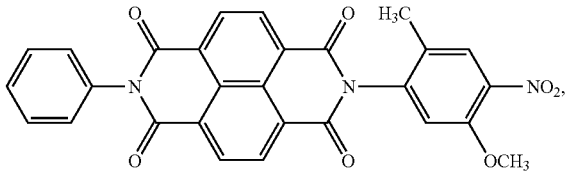

(2)

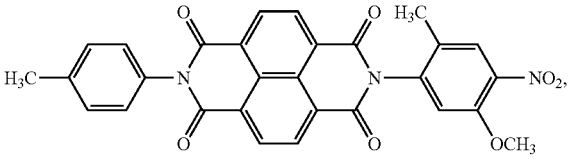

(3)

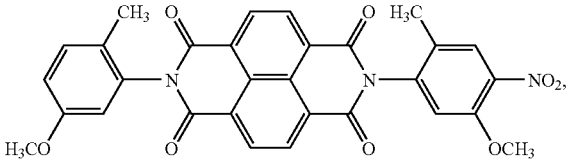

(4)

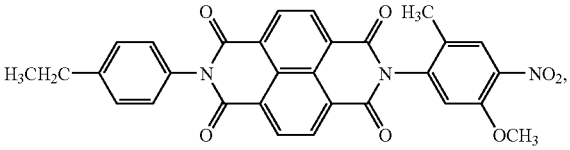

(5)

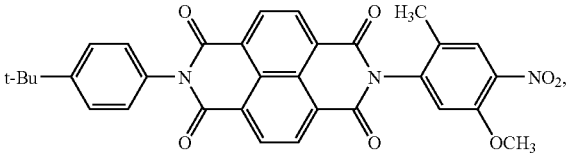

-continued (6)

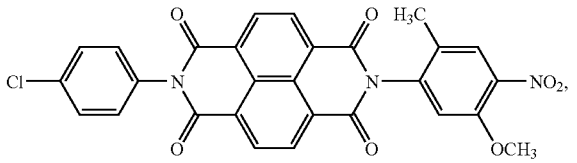

(7)

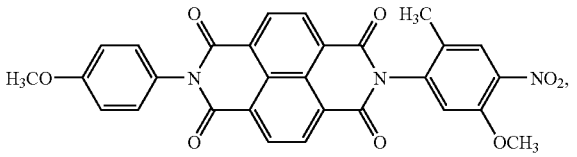

(8)

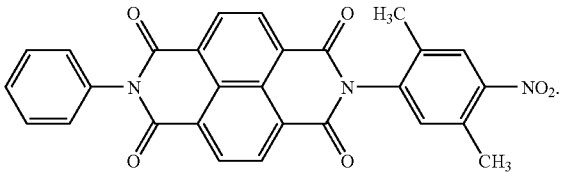

As is evident from the structures of compounds (1) through (8), the naphthalenetetracarboxylic acid diimide derivative according to an embodiment of the present invention has an asymmetric structure. The term "asymmetric" refers to a structure in which at least one of a kind, a number, or a substitution position of the substituents (H atom can be regarded as a substituent) substituted to each phenyl ring of the two phenyl rings bonded to nitrogen of the two imide bonds of the naphthalenetetracarboxylic acid structure is different. Because of such an asymmetric structure, the diimide derivative of the present invention has improved solubility in organic solvents and an excellent compatibility with polymer binder resins. Accordingly, the naphthalenetetracarboxylic acid diimide derivative according to an embodiment of the present invention exhibits noticeably improved electron transporting ability. In addition, electron transporting ability of the diimide derivative according to an embodiment of the present invention is further enhanced by introducing a nitro group having high electron affinity thereto.

Next, a method of preparing the naphthalenetetracarboxylic acid diimide derivative according to embodiments of the present invention will be described.

The naphthalenetetracarboxylic acid diimide derivative is prepared by reacting a naphthalenetetracarboxylic acid dianhydride having Formula 4 with a substituted or unsubstituted aniline compound having Formulas 5 and 6:

[Formula 4]

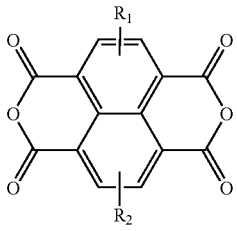

-continued

[Formula 5]

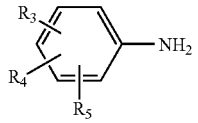

[Formula 6]

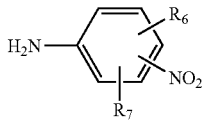

wherein $R_1$, $R_2$, $R_3$, $R_4$, $R_5$, $R_6$, and $R_7$ are as defined above.

In the reaction, a polar organic solvent, for example, dimethylformamide (DMF), dimethylacetamide (DMAc), hexamethylphosphoamide (HMPA), or N-methyl-2 pyrrolidone (NMP), may be used. The reaction temperature may be set in the range of 20° C. lower than the boiling point of the solvent to the boiling point of the solvent, and preferably in the range of 10° C. lower than the boiling point of the solvent to the boiling point of the solvent.

Generally, the reaction may be carried out in the following manner. First, the naphthalenetetracarboxylic acid dianhydride compound represented by Formula 4 is dissolved in a polar organic solvent such as DMF, DMAc, HMPA, or NMP, and then the compounds having Formulas 5 and 6 are added dropwise to the resulting solution. Then the mixture is refluxed for 3 to 24 hours, preferably 3 to 10 hours, to obtain the asymmetric naphthalenetetracarboxylic acid diimide derivative having a nitro group. In the reaction, the naphthalenetetracarboxylic acid dianhydride of Formula 4, the aniline compound of Formula 5, and the anilene compound of Formula 6 may be used in a molar ratio of 1:1:1. In the reaction, when the compound of Formula 5 reacts to both imide nitrogen atoms of Formula 4 or the compound of Formula 6 reacts to both imide nitrogen atoms of Formula 4, a symmetric naphthalenetetracarboxylic acid diimide derivative is obtained. The symmetric naphthalenetetracarboxylic acid diimide derivative has much less solubility in organic solvents than the asymmetric naphthalenetetracarboxylic acid diimide derivative according to an embodiment of the present invention. Therefore, the asymmetric naphthalenetetracarboxylic acid diimide derivative having a nitro group according to an embodiment of the present invention can be separated using a difference in solubility in organic solvents.

The amount of the electron transporting material of Formula 1 may be preferably 5-50 parts by weight with respect to 100 parts by weight of the charge generating material, preferably 10-40 parts by weight. If the amount of the electron transporting material is less than 5 parts by weight, the electron transporting material is not sufficient and the residual potential is not efficiently reduced. If the amount of the electron transporting material is greater than 50 parts by weight, the charge generating material is not sufficient and charges are not efficiently generated.

The charge generating material and the electron transporting material of the charge generating layer are dispersed and/or dissolved in the binder resin. Examples of the binder resin include polyvinyl acetal such as polyvinyl formal or polyvinyl butyral, polyester, polyamide, polyvinyl alcohol, polyvinylacetate, polyvinylchloride, polyurethanes, polycarbonate, (meth)acryl resin, polyvinylidene chloride, polystyrene, styrene-butadiene copolymer, styrene-methyl methacrylate copolymer, vinylidene chloride-acrylonitrile copolymer, vinyl chloride-vinyl acetate copolymer, vinyl chloride-vinyl acetate-maleic anhydride copolymer, ethylene acrylic acid copolymer, ethylene vinylacetate copolymer, methyl cellulose, ethylcellulose, nitrocellulose, carboxymethyl cellulose, silicone resin, silicone-alkyd resin, phenol-formaldehyde resin, cresol-formaldehyde resin, phenoxy resin, styrene-alkyd resin, poly-N-vinylcarbazole resin, polyhydroxystyrene, polynorbornene, polycyclo-olefin, polyvinylpyrrolidone, poly (2-ethyl-oxazoline), polysulfone, melamine resin, urea resin, amino resin, isocyanate resin, and epoxy resin. These polymers can be used alone or in combination of two or more.

The amount of the binder resin may be 5-350 parts by weight with respect to 100 parts by weight of the charge generating material, preferably 10-200 parts by weight. If the amount of the binder resin is less than 5 parts by weight, the charge generating material is not sufficiently dispersed and thus the stability of the dispersion for the charge generating layer is decreased and it is difficult to obtain a uniform charge generating layer when coating on the electrically conductive substrate and the adhesive force may be decreased. If the amount of the binder resin is greater than 350 parts by weight, it is difficult to maintain the charge potential, and a desired image cannot be obtained due to insufficient photosensitivity caused by too much binder resin.

The solvent used for manufacturing a coating slurry (dispersion) for forming the charge generating layer may vary according to the type of the binder resin used, and preferably, does not have an adverse effect on an adjacent layer when forming the charge generating layer. Examples of the solvent include methyl isopropyl ketone, methyl isobutyl ketone, 4-methoxy-4-methyl-2-pentanone, isopropyl acetate, t-butyl acetate, isopropyl alcohol, isobutyl alcohol, acetone, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofuran, dioxane, dioxolane, methanol, ethanol, 1-propanol, 1-butanol, 2-butanol, 1-methoxy-2-isopropanol, ethyl acetate, butyl acetate, dimethyl sulfoxide, methyl cellosolve, butyl amine, diethyl amine, ethylene diamine, isopropanol amine, triethanol amine, triethylene diamine, N,N'-dimethyl formamide, 1,2-dimethoxy ethane, benzene, toluene, xylene, methyl benzene, ethylbenzene, cyclohexane, and anisole. The solvent may be used alone or in combination of two or more.

The production of the coating slurry for the charge generating layer will now be explained. First, 100 parts by weight of the charge generating material including phthalocyanine pigment such as oxytitanyl phthalocyanine, 5-50 parts by weight of the electron transporting material of Formula 1, preferably 10-40 parts by weight, and 5-350 parts by weight of the binder resin, preferably 10-200 parts by weight, are mixed with an appropriate amount, for example, 100-10,000 parts by weight, preferably 500-8,000 parts by weight, of the solvent. Glass beads, steel beads, zirconia beads, alumina beads, zirconia balls, alumina balls, or steel balls are added to the resultant mixture and dispersed for 2-50 hours using a disperser. In this case, a mechanical milling method may be used. Examples of a milling apparatus that can be used include an attritor, a ball mill, a sand mill, and a Banbury mixer, a roll mill, a three-roll mill, a nanomizer, a microfluidizer, a stamp mill, a planetary mill, a vibrating mill, a kneader, a homogenizer, a micronizer, a paint shaker, a high-speed agitator, an ultimizer, a ultrasonic mill, etc. The milling apparatus may be used alone or in combination of two or more.

The coating slurry for the charge generating layer thus prepared is coated on the electrically conductive substrate described above. Examples of the coating method include dip coating, ring coating, roll coating, spray coating, etc. The coated electrically conductive substrate is dried at 90-200° C. for 0.1-2 hours to form a charge generating layer.

The thickness of the charge generating layer may be 0.001-10 μm, preferably 0.01-10 μm, more preferably 0.05-3 μm. If the thickness of the charge generating layer is less than 0.001 μm, the charge generating layer cannot be easily uniformly formed. If the thickness of the charge generating layer is greater than 10 μm, the charging ability and the photosensitivity thereof may be decreased.

Then a charge transporting layer comprising a charge transporting material and a binder resin is formed on the charge generating layer.

The charge transporting material includes a hole transporting material (HTM) which transports holes and an electron transporting material (ETM) which transports electrons. When the two-layered type photoreceptor is to be negatively charged, the HTM is used as the charge transporting material, and when the two-layered type photoreceptor is to have a bipolar property, i.e., to be positively/negatively-charged, a combination of the HTM and the ETM can be used as the charge transporting material.

The HTM that can be used in an embodiment of the present invention is not limited and includes a conventional HTM. Specific examples of the HTM include a nitrogen-containing cyclic compound or a condensed polycyclic compound, such as a hydrazone compound, a butadiene-based amine compound including N,N'-bis-(3-methyl phenyl)-N,N'-bis(phenyl)benzidine, N,N,N',N'-tetrakis (3-methyl phenyl) benzidine, N,N,N',N'-tetrakis (4-methylphenyl) benzidine, N,N'-di (naphthalene-1-yl)-N,N'-di (4-methyl phenyl) benzidine, and, N,N'-di (naphthalene-2-yl)-N,N'-di (3-methyl phenyl) benzidine and the like, a benzidine compound, a pyrene compound, a carbazole compound, an arylmethane compound, a thiazole compound, a styryl compound, a pyrazoline compound, an arylamine compound, an oxazole compound, an oxadiazole compound, a pyrazoline compound, a pyrazolone compound, a stilbene compound, a polyaryl alkane compound, a polyvinylcarbazole compound and a derivative thereof, an N-acrylamidemethylcarbazole polymer, a triphenylmethane polymer, a styrene copolymer, polyacenaphthene, polyindene, a copolymer of acenaphthylene and styrene, and a formaldehyde-based condensed resin, etc. Also, high molecular weight compounds or polysilane compounds having functional groups of the above compounds on a main chain or side chain may be used.

The ETM that can be used in an embodiment of the present invention includes a conventional ETM. Specific examples of the ETM include an electron attracting low-molecular weight compound such as a benzoquinone compound, a naphthoquinone compound, an anthraquinone compound, a malononitrile compound, a fluorenone compound, a cyanoethylene compound, a cyanoquinodimethane compound, a xanthone compound, a phenanthraquinone compound, an anhydrous phthalic acid compound, a thiopyrane compound, a dicyanofluorenone compound, a naphthalenetetracarboxylic acid diimide compound including the compound of Formula 1, a benzoquinoneimine compound, a diphenoquinone compound, a stilbene quinone compound, a diiminoquinone compound, a dioxotetracenedione compound, and a pyrane sulfide compound, and the like.

In addition, polymers having the electron absorbing low molecular compounds structures such as listed above as a main chain or a side chain; or organic pigments having a property of an n-type semiconductor such as perylene pigments, anthanthrone pigments, perinone pigments, bisazo pigments, and so forth; inorganic pigments such as titanium oxide, zinc oxide, cadmium sulfide, and the like may be used.

In the electrophotographic photoreceptor according to an embodiment of the present invention, the amount of the charge transporting material in the charge transporting layer may be 5-200 parts by weight with respect to 100 parts by weight of the binder resin of the charge transporting layer, preferably 10-150 parts by weight. If the amount of the charge transporting material is less than 5 parts by weight, the charge transporting ability is not sufficient and thus the photosensitivity is not sufficient, and the residual potential is likely to increase. If the amount of the charge generating material is greater than 200 parts by weight, the amount of the binder resin is decreased and thus the mechanical intensity is decreased.

However, the charge transporting material that can be used in an embodiment of the present invention is not limited to the above HTM or ETM and may include any HTM or ETM having a degree of charge mobility greater than $10^{-8}$ $cm^2/V$ sec. The above charge transporting material may be used alone or in combination of two or more.

When the charge transporting material is capable of forming a film, the charge transporting layer can be formed without the binder resin, but the low molecular weight material generally does not have a film forming ability. Thus, the charge transporting material is dissolved or dispersed in the binder resin to obtain a coating composition for the charge transporting layer. Then the composition is coated on the charge generating layer and dried, thereby forming the charge transporting layer. Examples of the binder resin that can be used in the charge transporting layer include an insulating resin having a film forming ability, such as polyvinyl butyral, polyarylate (for example, a condensation polymer of bisphenol A and phthalic acid, etc.), polycarbonate, polyester resin, phenoxy resin, polyvinyl acetate, acrylic resin, polyacrylamide resin, polyamide, polyvinyl pyridine, cellulose based resins, urethane resin, epoxy resin, silicon resin, polystyrene, polyketone, polyvinyl chloride, polyvinyl chloride-acrylic acid copolymers, polyvinyl acetal, polyacrylonitrile, phenolic resin, melamine resin, casein, polyvinyl alcohol, polyvinylpyrrolidone, etc., and an organic photoconductive resin such as poly N-vinylcarbazole, polyvinyl anthracene, polyvinylpyrene, etc.

The present inventors discovered that it is preferable that the binder resin for the charge transporting layer is polycarbonate resin, particularly polycarbonate-Z derived from cyclohexylidene bisphenol, rather than polycarbonate-A derived from bisphenol A or polycarbonate-C derived from methyl bisphenol A, since the polycarbonate-Z has a higher glass transition temperature and is more resistant to abrasion.

The charge transporting layer of the electrophotographic photoreceptor according to an embodiment of the present invention may comprise a phosphate compound, a phosphine oxide compound, or a mixture thereof, and silicone oil, in order to increase the resistance to abrasion of the charge transporting layer and provide smoothness (=slip property) to a surface of the charge transporting layer.

A solvent used in the production of the coating composition for the charge transporting layer of the electrophotographic photoreceptor according to an embodiment of the present invention can vary according to the type of the binder resin used, and preferably, does not have an adverse effect on the charge generating layer disposed under the charge transporting layer.

Examples of the solvent include aromatic hydrocarbons, such as benzene, xylene, ligroin, monochlorobenzene, and dichlorobenzene; ketones, such as acetone, methylethyl ketone, and cyclohexanone; alcohols, such as methanol, ethanol, and isopropanol; esters, such as ethyl acetate and methyl cellosolve; halogenated aliphatic hydrocarbons, such as carbon tetrachloride, chloroform, dichloromethane, dichloroethane, and trichloroethylene; ethers, such as tetrahydrofuran, dioxane, dioxolane, ethylene glycol, and monomethyl ether; amides, such as N,N-dimethyl formamide and N,N-dimethyl acetamide; and sulfoxides, such as dimethylsulfoxide. The solvent may be used alone or in combination of two or more.

The production of the coating composition for the charge transporting layer will now be explained. First, 100 parts by weight of the binder resin, 5-200 parts by weight of the charge transporting material, optionally 0.01-10 parts by weight of the phosphate compound and/or the phosphine oxide compound, and optionally 0.01-1 parts by weight of the silicone oil are mixed with an appropriate amount, for example, 100-1,500 parts by weight, preferably 300-1,200 parts by weight, of the solvent, and then the resultant mixture is stirred homogeneously.

The coating composition for the charge transporting layer thus prepared is coated on the charge generating layer. Examples of the coating method include dip coating, ring coating, roll coating, and spray coating, etc., as described above. The coated substrate is dried at 90-200° C. for 0.1-2 hours to form the charge transporting layer.

The thickness of the charge generating layer may be 2-100 μm, preferably 5-50 μm, more preferably, 10-40 μm. If the thickness of the charge transporting layer is less than 2 μm, it is too thin, and thus the durability of the charge transporting layer is insufficient and the charging property is deteriorated. If the thickness of the charge transporting layer is greater than 100 μm, the physical resistance to abrasion increases but the response speed and the image quality decrease.

The electrophotographic photoreceptor according to an embodiment of the present invention may include additives such as antioxidants, photostabilizers, plasticizers, leveling agents, dispersion stabilizers and the like in the charge transporting layer and/or charge generating layer in order to improve resistance to the environment, stability to harmful light or processibility.

Examples of the antioxidant include a conventional antioxidant such as a hindered phenol-based compounds, sulfide, phosphonic acid ester-based compound, phosphorous acid ester-based compound, and amine compounds. Examples of the photostabilizer include a conventional optical stabilizer such as benzotriazole-based compound, benzophenone-based compounds, and hindered amine compound, but are not limited thereto.

Also, the electrophotographic photoreceptor according to an embodiment of the present invention may further include a surface protecting layer when necessary.

The two-layered type electrophotographic photoreceptor according to an embodiment of the present invention can be integrated into electrophotographic image forming apparatuses such as laser printers, photocopiers, and facsimile machines.

FIG. 1 is a schematic view of an electrophotographic image forming apparatus according to an embodiment of the present invention. Referring to FIG. 1, reference numeral 1 indicates a semiconductor laser. Laser light that is signal-modulated by a control circuit 11 according to image information, after being radiated is collimated by an optical correction system 2 and performs scanning while being reflected by a polygonal rotatory mirror 3. The laser light is focused on a surface of an electrophotographic photoreceptor 5 by a scanning lens 4 to expose a region of the surface according to the image information. The electrophotographic photoreceptor is previously charged by a charging apparatus 6, and thus an electrostatic latent image is formed on the surface through the exposure process and then turned into a toned image by a developing apparatus 7. The toned image is transferred to an image receptor 12, such as paper, by a transferring apparatus 8, and fixed as a print result by a fixing apparatus 10. The electrophotographic photoreceptor can be repeatedly used by removing a coloring agent remaining on the surface thereof using a cleaning apparatus 9. Although the electrophotographic photoreceptor in FIG. 1 is a drum type, an electrophotographic photoreceptor according to the present invention can be formed as a plate or a belt.

Hereinafter, the present invention will be described in detail with reference to the following examples. However, these examples are for illustrative purposes only and are not intended to limit the scope of the invention.

EXAMPLES

Synthesis Example 1

Synthesis of Compound (1)

The following is a description of the synthesis of a naphthalenetetracarboxylic acid diimide compound (1) having the formula below.

(1)

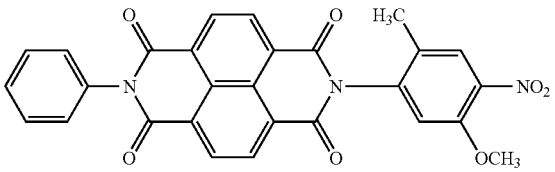

Figure 2:
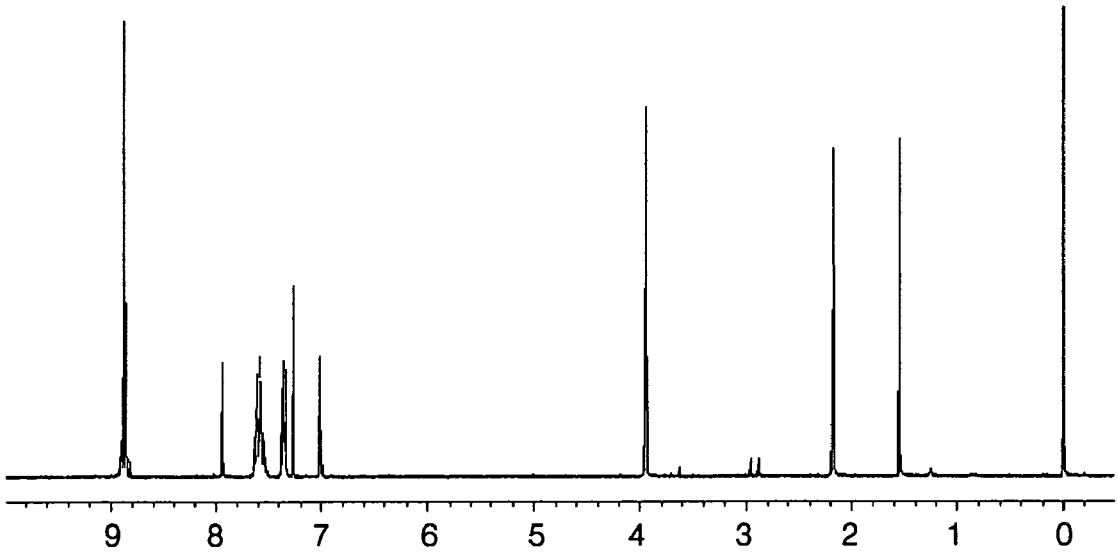
FIG. 2 is an NMR spectrum of a naphthalenetetracarboxylic acid diimide compound (1) obtained in Synthesis Example 1 according to an embodiment of the present invention.

A 250 ml three neck flask equipped with a reflux condenser was purged with nitrogen, and then 13.4 g (0.05 mol) of naphthalene-1,4,5,8-tetracarboxylic acid dianhydride and 500 ml of DMF were poured thereinto and stirred to obtain a solution. After the solution was warmed to a reflux temperature, a solution of 9.15 g (0.05 mol) of 5-methoxy-2-methyl-4-nitroaniline and 4.7 g (0.05 mol) of aniline in 50 ml of DMF was slowly added dropwise to the flask, and then the mixture was refluxed for 4 hours and cooled to room temperature. The mixture was added to 1000 ml of methanol and precipitated to obtain a solid. The resultant solid was recrystallized from a chloroform/methanol solvent and dried in a vacuum to obtain 22.0 g of the compound (1) as a light yellow crystal (yield 88%). The $^1$H-NMR (300 MHz, $CDCl_3$ solvent) spectrum of the obtained compound (I) is shown in FIG. 2.

Synthesis Example 2

Synthesis of Compound (2)

The following is a description of the synthesis of a naphthalenetetracarboxylic acid diimide compound (2) having the formula below.

(2)

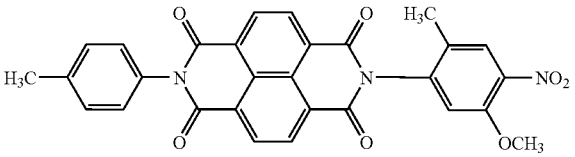

Figure 3:
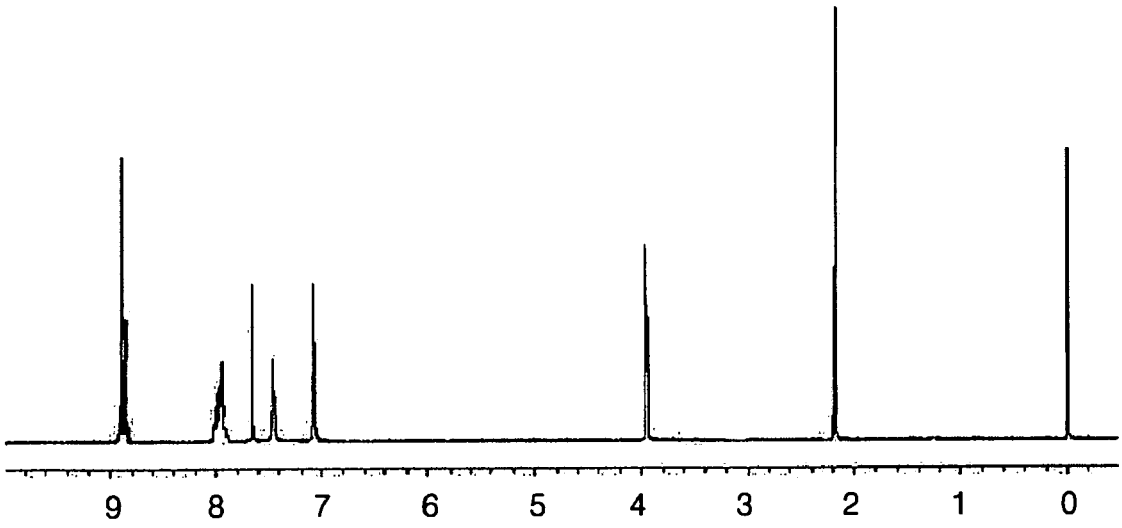
FIG. 3 is an NMR spectrum of a naphthalenetetracarboxylic acid diimide compound (2) obtained in Synthesis Example 2 according to an embodiment of the present invention.

21.2 g of the naphthalenetetracarboxylic acid diimide compound (2) was prepared as a light yellow crystal in the same manner as in Synthesis Example 1, except that 5.34 g (0.05 mol) of 4-methylaniline was used instead of aniline (yield 81%). The $^1$H-NMR (300 MHz, $CDCl_3$) spectrum of the obtained compound (2) is shown in FIG. 3.

Synthesis Example 3

Synthesis of Compound (3)

The following is a description of the synthesis of a naphthalenetetracarboxylic acid diimide compound (3) having the formula below.

(3)

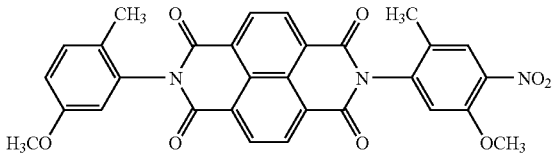

Figure 4:
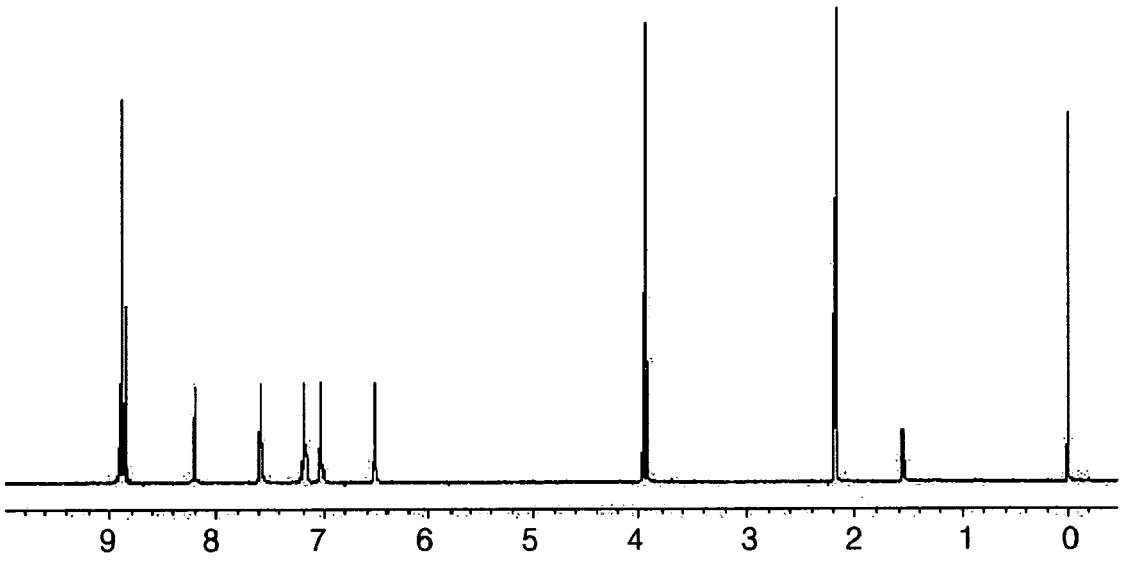
FIG. 4 is an NMR spectrum of a naphthalenetetracarboxylic acid diimide compound (3) obtained in Synthesis Example 3 according to an embodiment of the present invention.

22.8 g of the naphthalenetetracarboxylic acid diimide compound (8) was prepared as a light yellow crystal in the same manner as in Synthesis Example 1, except that 6.86 g (0.05 mol) of 5-methoxy-2-methylaniline was used instead of aniline (yield 83%). The $^1$H-NMR (300 MHz, $CDCl_3$) spectrum of the obtained compound (3) is shown in FIG. 4.

Example 1

20 parts by weight of y-oxytitanyl phthalocyanine (y-TiOPc) represented by Formula 9 as a charge generating material, 2 parts by weight of the naphthalenetetracarboxylic acid diimide compound (1) as an electron transporting material, 13 parts by weight of the binder resin (DENKI KAGAKU KOGYO KABUSHIKI KAISHA, PVB 6000-C), and 635 parts by weight of tetrahydrofuran (THF) were sand milled for 2 hours and uniformly dispersed using ultrasonic waves. The obtained coating slurry for the charge generating layer was coated on an anodized aluminum drum (the thickness of the anodized film was 5 μm) with an external diameter of 24 mm and a length of 236 mm using a ring coating method and dried at 120° C. for about 20 minutes to prepare a charge generating layer (CGL) having a thickness of 0.5 μm.

Next, 45 parts by weight of the enamine stilbene-based compound (10) below as an HTM, 55 parts by weight of the polycarbonate-Z binder resin of the compound (11) below (Mitsubishi Gas Chemical, PCZ200) were dissolved in 426 parts by weight of a mixture solvent of THF/toluene (weight ratio=4/1) to prepare a coating solution for the charge transporting layer. The obtained coating solution was uniformly coated on the charge generating layer and dried in an oven at 120° C. for 30 minutes to prepare a charge transporting layer (CTL) having a thickness of 20 μm, and thus a negatively-charged (−) type two-layered type photosensitive drum was manufactured.

(9)

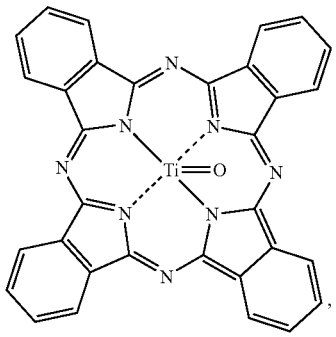

(10)

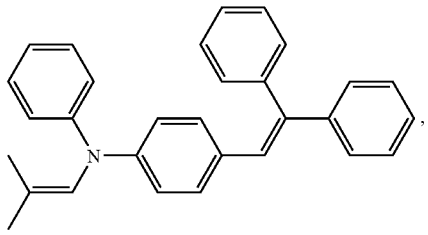

(11)

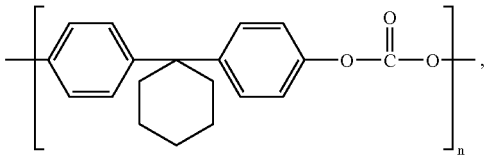

(12)

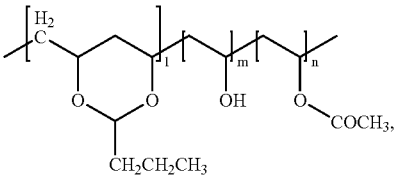

1 : m : n = 81 : 17 : 2

(13)

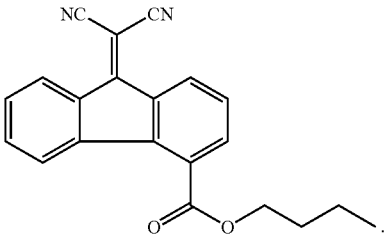

Example 2

A negatively-charged (−) type two-layered photosensitive drum was prepared in the same manner as in Example 1, except that the amount of the naphthalenetetracarboxylic acid diimide compound (1) was changed to 5 parts by weight.

Example 3

A negatively-charged (−) type two-layered photosensitive drum was prepared in the same manner as in Example 1, except that the amount of the naphthalenetetracarboxylic acid diimide compound (1) was changed to 7 parts by weight.

Example 4

A negatively-charged (−) type two-layered photosensitive drum was prepared in the same manner as in Example 1, except that 2 parts by weight of the naphthalenetetracarboxylic acid diimide compound (2) was used instead of the naphthalenetetracarboxylic acid diimide compound (1).

Example 5

A negatively-charged (−) type two-layered photosensitive drum was prepared in the same manner as in Example 1, except that 5 parts by weight of the naphthalenetetracarboxylic acid diimide compound (2) was used instead of the naphthalenetetracarboxylic acid diimide compound (1).

Example 6

A negatively-charged (−) type two-layered photosensitive drum was prepared in the same manner as in Example 1, except that 7 parts by weight of the naphthalenetetracarboxylic acid diimide compound (2) was used instead of the naphthalenetetracarboxylic acid diimide compound (1).

Example 7

A negatively-charged (−) type two-layered photosensitive drum was prepared in the same manner as in Example 1, except that 2 parts by weight of the naphthalenetetracarboxylic acid diimide compound (3) was used instead of the naphthalenetetracarboxylic acid diimide compound (1).

Example 8

A negatively-charged (−) type two-layered photosensitive drum was prepared in the same manner as in Example 1, except 5 parts by weight of the naphthalenetetracarboxylic acid diimide compound (3) was used instead of the naphthalenetetracarboxylic acid diimide compound (1).

Example 9

A negatively-charged (−) type two-layered photosensitive drum was prepared in the same manner as in Example 1, except that 7 parts by weight of the naphthalenetetracarboxylic acid diimide compound (3) was used instead of the naphthalenetetracarboxylic acid diimide compound (1).

Comparative Example 1

A mixture obtained by mixing 20 parts by weight of y-oxytitanyl phthalocyanine (y-TiOPc) represented by Formula 9 above as a charge generating material, 18 parts by weight of PVB binder resin of the compound (12) above (DENKI KAGAKU KOGYO KABUSHIKI KAISHA, PVB 6000-C), and 635 parts by weight of tetrahydrofuran (THF) was sand milled for 2 hours and treated with ultrasonic waves. The obtained slurry for the charge generating layer was coated uniformly on an anodized aluminum drum (anodic oxide layer thickness: 5 μm) having an external diameter of 24 mm and a length of 236 mm and dried in an oven at 120° C. for 20 minutes and thus a charge generating layer having a thickness of 0.5 μm was prepared.

Next, 45 parts by weight of the enamine stilbene-based compound (10) below as an HTM, and 55 parts by weight of the polycarbonate-Z binder resin of the compound (11) above (Mitsubishi Gas Chemical, PCZ200) were dissolved in 426 parts by weight of a mixture solvent of THF/toluene (weight ratio=4/1) to prepare a coating solution for the charge transporting layer. The obtained coating solution was uniformly coated on the charge generating layer and dried in an oven at 120° C. for 30 minutes to prepare a charge transporting layer (CTL) having a thickness of 20 μm, and thus a negatively-charged (−) type two-layered photosensitive drum was manufactured.

Comparative Example 2

A negatively-charged (−) type two-layered photosensitive drum was prepared in the same manner as in Comparative Example 1, except that the amount of the PVB binder resin was changed to 13 parts by weight.

Comparative Example 3

A negatively-charged (−) type two-layered photosensitive drum was prepared in the same manner as in Example 1, except that 2 parts by weight of the dicyanofluorenone compound (13) was used instead of the naphthalenetetracarboxylic acid diimide compound (1).

Comparative Example 4

A negatively-charged (−) type two-layered photosensitive drum was prepared in the same manner as in Example 1, except that 5 parts by weight of the dicyanofluorenone compound (13) was used instead of the naphthalenetetracarboxylic acid diimide compound (1).

Comparative Example 5

A negatively-charged (−) type two-layered photosensitive drum was prepared in the same manner as in Example 1, except that 7 parts by weight of the dicyanofluorenone compound (13) was used instead of the naphthalenetetracarboxylic acid diimide compound (1).

Measurements of Electrical Properties

Electrical properties of the respective electrophotographic photoreceptors prepared in. Examples 1 through 9 and Comparative Examples 1 through 5 were measured using a drum type photoreceptor evaluation apparatus ("PDT-2000" manufactured by QEA) at 23° C. and at a humidity of 50% as follows. A corona voltage of −7.5 kV was applied to the electrophotographic photosensitive drum at a relative speed of the charging device and the photoreceptor of 100 mm/sec so that the charge potential value Vo of the electrophotographic photosensitive drum was 800 V. Next, a monochromatic light having a wavelength of 780 nm was radiated onto the surface of the electrophotographic photosensitive drum and the surface potential value of the photosensitive drum was recorded, and the relationship between the exposure energy and the surface potentials of the photosensitive drum was measured. The results are listed in Table 1. In Table 1, $E_{1/2}$ (μJ/cm$^2$) denotes a light energy that is necessary for the surface potential of the photoreceptor to be ½ of the initial potential of Vo, and $E_{200}$(μJ/cm$^2$) denotes a light energy that is necessary for the surface potential of the photoreceptor to be 200 V. The smaller these values, the better the photosensitivity of the electrophotographic photoreceptor. $E_{0.25}$(V) denotes a surface potential of the photoreceptor when a light energy of 0.25 μJ/cm$^2$ was irradiated and indicates the amount of the residual potential.

TABLE 1

| | CGL COMPOSITION | | | $E_{1/2}$ | $E_{200}$ | $E_{0.25}$ |
|---|---|---|---|---|---|---|
| | CGM | ETM | BINDER RESIN | (μJ/cm$^2$) | (μJ/cm$^2$) | (V) |
| Example 1 | y-TiOPc 20 parts by weight | compound (1) 2 parts by weight | PVB 13 parts by weight | 0.092 | 0.148 | 70 |
| Example 2 | y-TiOPc 20 parts by weight | compound (1) 5 parts by weight | PVB 13 parts by weight | 0.093 | 0.149 | 62 |
| Example 3 | y-TiOPc 20 parts by weight | compound (1) 7 parts by weight | PVB 13 parts by weight | 0.092 | 0.148 | 61 |
| Example 4 | y-TiOPc 20 parts by weight | compound (2) 2 parts by weight | PVB 13 parts by weight | 0.092 | 0.146 | 68 |
| Example 5 | y-TiOPc 20 parts by weight | compound (2) 5 parts by weight | PVB 13 parts by weight | 0.091 | 0.144 | 58 |
| Example 6 | y-TiOPc 20 parts by weight | compound (2) 7 parts by weight | PVB 13 parts by weight | 0.093 | 0.145 | 55 |
| Example 7 | y-TiOPc 20 parts by weight | compound (3) 2 parts by weight | PVB 13 parts by weight | 0.094 | 0.150 | 67 |
| Example 8 | y-TiOPc 20 parts by weight | compound (3) 5 parts by weight | PVB 13 parts by weight | 0.094 | 0.148 | 60 |
| Example 9 | y-TiOPc 20 parts by weight | compound (3) 7 parts by weight | PVB 13 parts by weight | 0.095 | 0.149 | 60 |
| Comparative Example 1 | y-TiOPc 20 parts by weight | — | PVB 13 parts by weight | 0.098 | 0.162 | 104 |
| Comparative Example 2 | y-TiOPc 20 parts by weight | — | PVB 13 parts by weight | 0.099 | 0.160 | 79 |
| Comparative Example 3 | y-TiOPc 20 parts by weight | compound (13) 2 parts by weight | PVB 13 parts by weight | 0.104 | 0.184 | 110 |
| Comparative Example 4 | y-TiOPc 20 parts by weight | compound (13) 5 parts by weight | PVB 13 parts by weight | 0.105 | 0.185 | 112 |
| Comparative Example 5 | y-TiOPc 20 parts by weight | compound (13) 7 parts by weight | PVB 13 parts by weight | 0.105 | 0.185 | 112 |

Referring to Table 1, the electrophotographic photoreceptor of Examples 1 through 9 where the asymmetric naphthalenetetracarboxylic acid diimide compounds (1), (2), or (3) having a nitro group are included as an electron transporting material besides a charge generating material, y-TiOPc, has relatively low values of $E_{1/2}$, $E_{200}$ and $E_{0.25}$ compared to the electrophotographic photoreceptor in Comparative Examples 1 through 5. Accordingly, the electrophotographic photoreceptor in Examples 1 through 9 according to the present invention has better photosensitivity and lower residual potential than the electrophotographic photoreceptor in Comparative Examples 1 through 5. In particular, $E_{0.25}$ in Examples 1 through 9 is remarkably smaller than the $E_{0.25}$ in Comparative Examples 1 and 2 where an ETM is not included in the charge generating layer as in a conventional two-layered type electrophotographic photoreceptor. This indicates that residual potential is significantly reduced when using the electrophotograhpic photoreceptor of Examples 1 through 9, thereby obtaining a good image. It is presumed that electrons generated in the charge generating layer flow efficiently through the ETM and this in turn facilitates charge generation, thereby reducing $E_{0.25}$. Consequently, when the CGL of the two-layered type electrophotographic photoreceptor includes an asymmetric naphthalenetetracarboxylic acid diimide compound having a nitro group as an ETM, the electrical properties of the electrophotograhpic photoreceptor are improved.

Referring to Table 1 again, it is noticeable that in Comparative Examples 3 through 5 where a dicyanofluorenone compound (13) is included as an ETM, $E_{1/2}$, $E_{200}$ and $E_{0.25}$ thereof are greater than in Comparative Examples 1 and 2 where no ETM is included in the charge generating layer. This indicates that the electrical properties of the two-layered type electrophotographic photoreceptor in Comparative Examples 3 through 5 are worse than the electrical properties in Comparative Examples 1 and 2 where no ETM is included in the CGL.

Meanwhile, the amount of the binder resin of the CGL was sufficient in the electrophotographic photoreceptor in Embodiments 1 through 9, and thus the adhesive forces between the CGL and the aluminum drum and between the CGL and the CTL were good.

As described above, the two-layered type electrophotographic photoreceptor including an asymmetric naphthalenetetracarboxylic acid diimide compound having a nitro group in the charge generating layer in addition to a charge generating material has a good interlayer adhesive force and high photosensitivity, and the residual potential is low after exposure. Accordingly, a good quality image can be obtained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic photoreceptor comprising:

an electrically conductive substrate;

a charge generating layer disposed on the electrically conductive substrate and comprises a charge generating material dispersed or dissolved in a binder resin and a naphthalenetetracarboxylic acid diimide derivative represented by Formula 1 and dispersed or dissolved in the binder resin; and a charge transporting layer disposed on the charge generating layer and comprises a charge transporting material dispersed or dissolved in a binder resin,

[Formula 1]

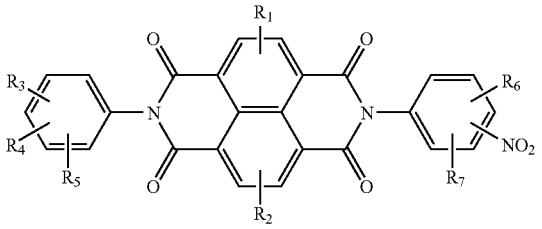

wherein $R_1$, $R_2$, $R_3$, $R_4$, $R_5$, $R_6$, and $R_7$ are each independently selected from the group consisting of a hydrogen atom, a halogen atom, a substituted or unsubstituted $C_1$-$C_{20}$ alkyl group, a substituted or unsubstituted $C_1$-$C_{20}$ alkoxy group, a substituted or unsubstituted $C_6$-$C_{30}$ aryl group, and a substituted or unsubstituted $C_7$-$C_{30}$ aralkyl group.

2. The electrophotographic photoreceptor of claim 1, wherein the charge generating material is a metal-free phthalocyanine compound represented by Formula 2 below, metal phthalocyanine compound represented by Formula $_3$, or a mixture of thereof,

[Formula 2]

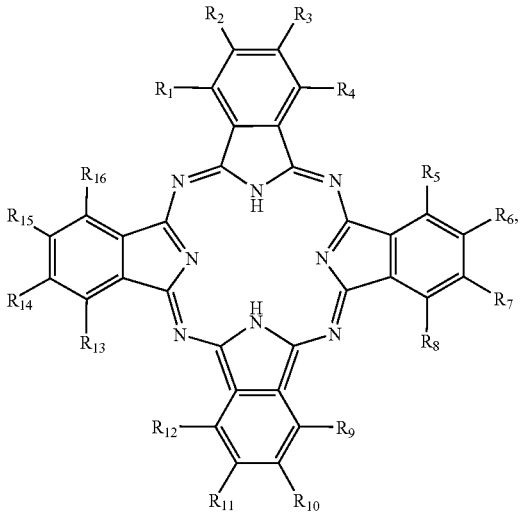

[Formula 3]

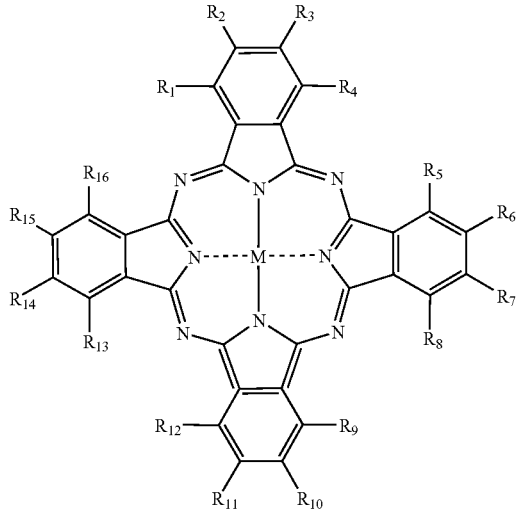

wherein $R_1$-$R_{16}$ are each independently a hydrogen atom, a halogen atom, a nitro group, a substituted or unsubstituted $C_1$-$C_{20}$ alkyl group, or a substituted or unsubstituted $C_1$-$C_{20}$ alkoxy group, and M is copper, chloroaluminum, chloroindium, chlorogallium, chlorogermanium, oxyvanadyl, oxytitanyl, hydroxygermanium, or hydroxygallium.

3. The electrophotographic photoreceptor of claim 1, wherein the amount of the binder resin in the charge generating layer is 5-350 parts by weight with respect to 100 parts by weight of the charge generating material.

4. The electrophotographic photoreceptor of claim 1, wherein the amount of the electron transporting material of Formula 1 is 5-50 parts by weight with respect to 100 parts by weight of the charge generating material.

5. The electrophotographic photoreceptor of claim 1, wherein the charge transporting material in the charge transporting layer is a hole transporting material.

6. The electrophotographic photoreceptor of claim 1, wherein the amount of the charge transporting material in the charge transporting layer is 5-200 parts by weight with respect to 100 parts by weight of the binder resin of the charge transporting layer.

7. The electrophotographic photoreceptor of claim 1, wherein the binder resin of the charge generating layer is polyvinyl butyral resin, and the binder resin of the charge transporting layer is polycarbonate-Z resin.

8. The electrophotographic photoreceptor of claim 1, wherein said asymmetric naphthalenetetracarboxylic acid diimide derivative is selected from the group consisting of (1)

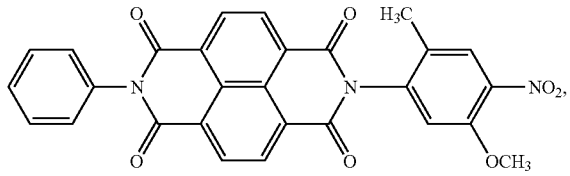

(2)

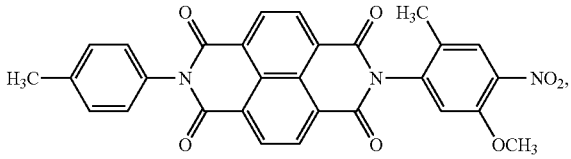

(3)

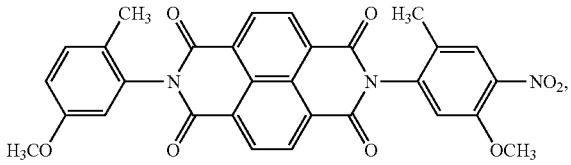

(4)

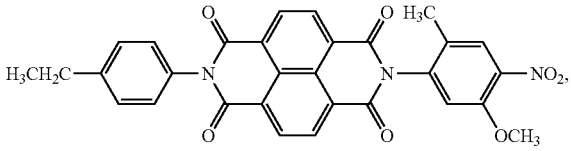

-continued (5)

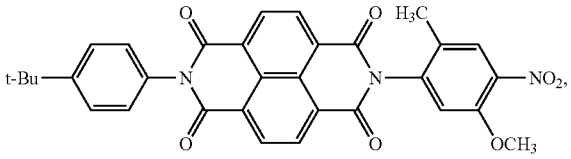

(6)

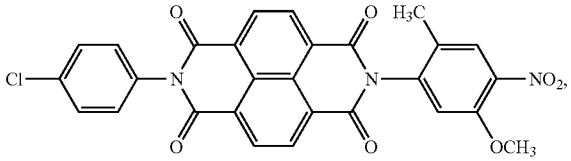

(7)

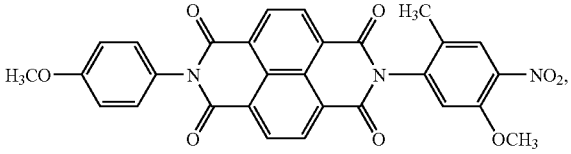

and (8)

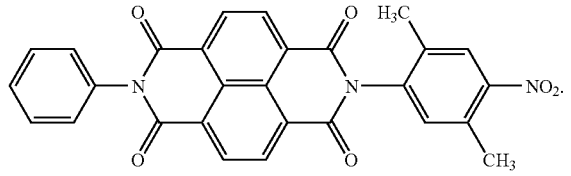

9. An electrophotographic image forming apparatus comprising an electrophotographic photoreceptor, wherein the electrophotographic photoreceptor comprises:

an electrically conductive substrate;

a charge generating layer disposed on the electrically conductive substrate and comprises a charge generating material dispersed or dissolved in a binder resin and a naphthalenetetracarboxylic acid diimide derivative represented by Formula 1 and dispersed or dissolved in the binder resin; and a charge transporting layer disposed on the charge generating layer and comprises a charge transporting material that is dispersed or dissolved in a binder resin,

[Formula 1]

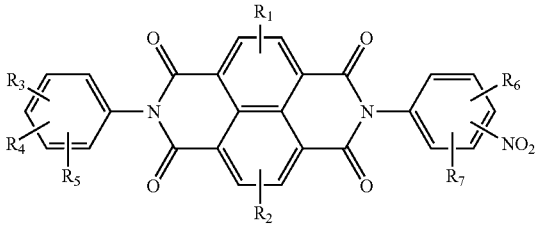

wherein $R_1$, $R_2$, $R_3$, $R_4$, $R_5$, $R_6$, and $R_7$ are each independently selected from the group consisting of a hydrogen atom, a halogen atom, a substituted or unsubstituted $C_1$-$C_{20}$ alkyl group, a substituted or unsubstituted $C_1$-$C_{20}$ alkoxy group, a substituted or unsubstituted $C_6$-$C_{30}$ aryl group, and a substituted or unsubstituted $C_7$-$C_{30}$ aralkyl group.

10. The electrophotographic image forming apparatus of claim 9, wherein the charge generating material is a metal-free phthalocyanine compound represented by Formula 2 below, metal phthalocyanine compound represented by Formula 3, or a mixture thereof,

[Formula 2]

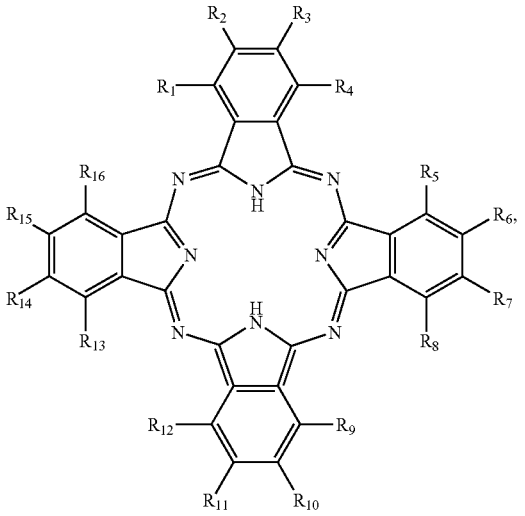

[Formula 3]

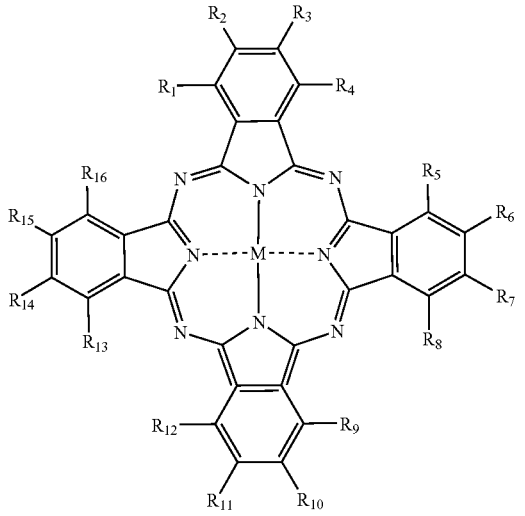

wherein $R_1$-$R_{16}$ are each independently a hydrogen atom, a halogen atom, a nitro group, a substituted or unsubstituted $C_1$-$C_{20}$ alkyl group, or a substituted or unsubstituted $C_1$-$C_{20}$ alkoxy group, and M is copper, chloroaluminum, chloroindium, chlorogallium, chlorogermanium, oxyvanadyl, oxytitanyl, hydroxygermanium, or hydroxygallium.

11. The electrophotographic image forming apparatus of claim 9, wherein the amount of the binder resin in the charge generating layer is 5-350 parts by weight with respect to 100 parts by weight of the charge generating material.

12. The electrophotographic image forming apparatus of claim 9, wherein the amount of the electron transporting material of Formula 1 is 5-50 parts by weight with respect to 100 parts by weight of the charge generating material.

13. The electrophotographic image forming apparatus of claim 9, wherein the charge transporting material in the charge transporting layer is a hole transporting material.

14. The electrophotographic image forming apparatus of claim 9, wherein the amount of the charge transporting material in the charge transporting layer is 5-200 parts by weight with respect to 100 parts by weight of the binder resin of the charge transporting layer.

15. The electrophotographic image forming apparatus of claim 9, wherein the binder resin of the charge generating layer is polyvinyl butyral resin, and the binder resin of the charge transporting layer is polycarbonate-Z resin.

16. The electrophotographic image forming apparatus of claim 9, wherein said asymmetric naphthalenetetracarboxylic acid diimide derivative is selected from the group consisting of (1)

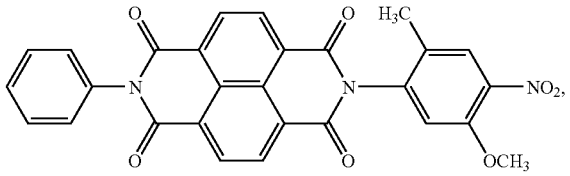

(2)

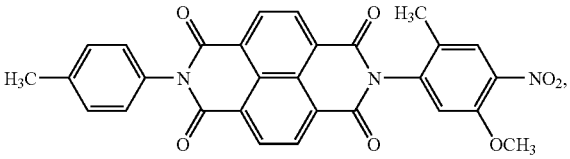

(3)

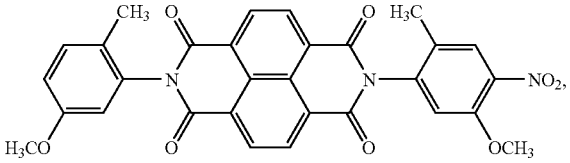

(4)

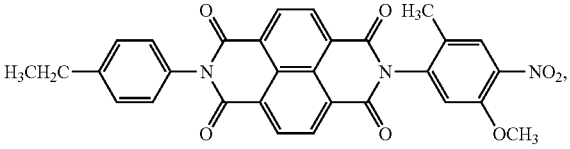

(5)

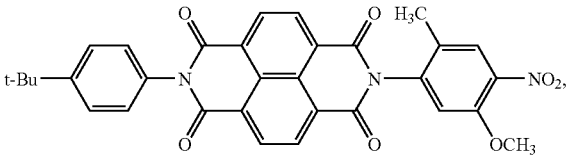

(6)

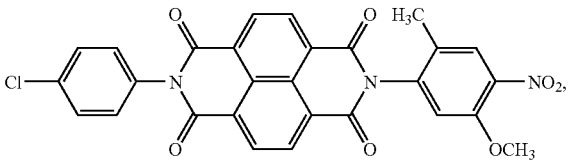

-continued
(7)
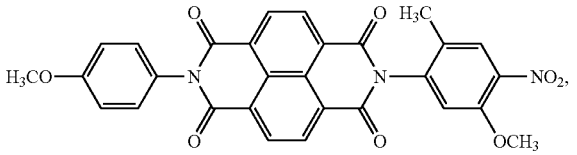
and
-continued
(8)
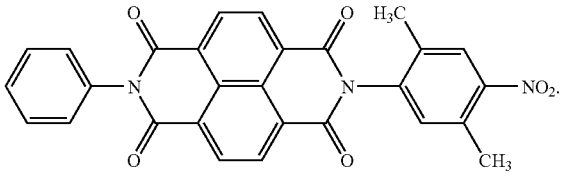
* * * * *